United States Patent [19]
Bakhir et al.
[11] 4,365,507
[45] Dec. 28, 1982

[54] METHOD OF DETERMINING THE DEPTH OF OCCURRENCE OF A CHEMICALLY AGGRESSIVE BED

[76] Inventors: Vitold M. Bakhir, proezd Gaidara, 7a, kv. 17; Stanislav A. Alekhin, Chilanzar, kvartal 24, 53, kv. 89; Tatiana M. Bakhir, proezd Gaidara, 7a, kv. 17; Raisa I. Born, Chilanzar, kvartal 24, 53, kv. 89, all of Tashkent; Khamidulla A. Alimdzhanov, ulitsa Lenina, 14, kv. 5, Bukhara, all of U.S.S.R.

[21] Appl. No.: 224,525

[22] PCT Filed: Aug. 21, 1979

[86] PCT No.: PCT/SU79/00068

§ 371 Date: Nov. 26, 1980

§ 102(e) Date: Nov. 24, 1980

[87] PCT Pub. No.: WO80/02052

PCT Pub. Date: Oct. 2, 1980

[30] Foreign Application Priority Data

Mar. 26, 1979 [SU] U.S.S.R. ..... 2736510

[51] Int. Cl.[3] ..... E21B 47/00
[52] U.S. Cl. ..... 73/153; 436/28
[58] Field of Search ..... 73/155, 153; 324/438; 175/40; 23/230 EP

[56] References Cited

U.S. PATENT DOCUMENTS 4,154,660 5/1979 Micko ..... 324/438 X

FOREIGN PATENT DOCUMENTS 484301 3/1976 U.S.S.R. .

OTHER PUBLICATIONS

Vendelshtein, "Study of Sections of Oil and Gas Production Wells by the Method of Proper Potentials", pp. 148–149.

*Primary Examiner*—Jerry W. Myracle
*Attorney, Agent, or Firm*—Fleit & Jacobson

[57] ABSTRACT

A method of determining the depth of occurrence of a chemically aggressive bed in the course of drilling a well with the use of a drilling mud, wherein there is measured preliminarily the value and direction of the redox potential of the drilling mud injected into the well, whereupon the walls of the well are stripped of the mud cake and an additional portion of the drilling mud featuring its redox potential differing as to the value and direction from the redox potential of the drilling mud situated in the well, is prepared.

The additional portion of the drilling mud is injected into the well until the mud is completely expelled therefrom, after which the circulation of the additional portion of the drilling mud is suspended for a period for a period of time, wherein relaxation of the ion-exchange processes between the chemically aggressive bed and the additional portion of the drilling bed occurs, whereupon the additional portion of the mud resumes circulation, while the time interval between the resuming of the mud circulation till the beginning and end of returning the amount of the additional mud portion that has been in contact with the chemically aggressive bed, is registered against the deviation of the value and direction of the redox potential of the drilling mud, whereupon proceeding from said deviation the depth and interval of occurrence of the chemically aggressive bed is estimated.

3 Claims, 1 Drawing Figure

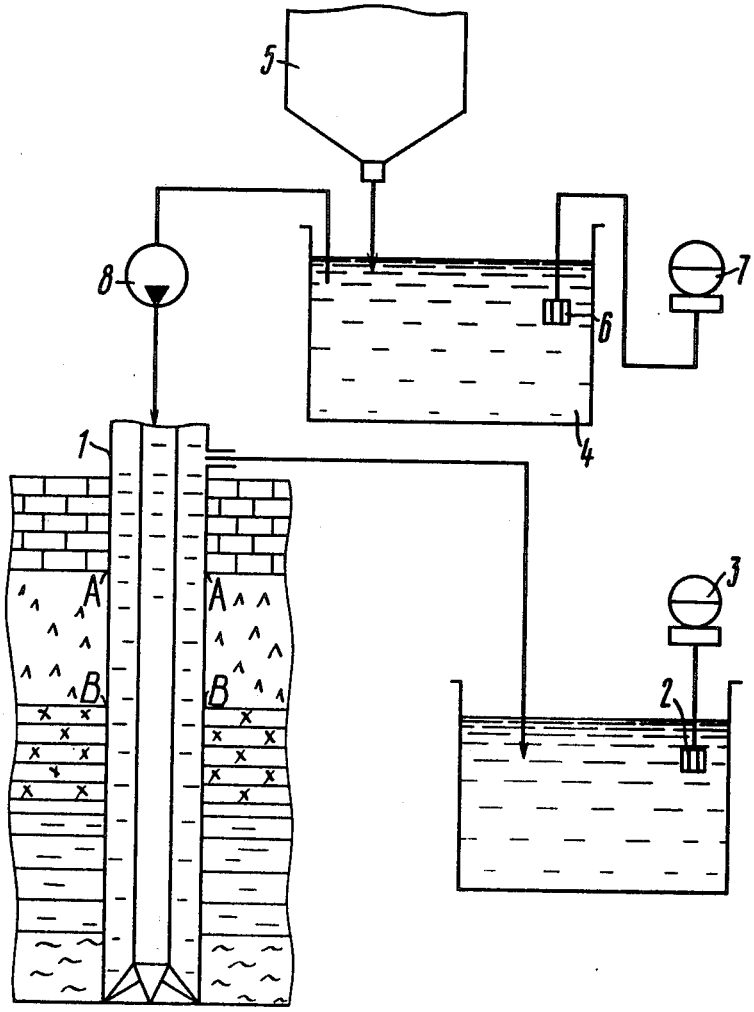
5
8
7
6
4
1
A
A
B
B
3
2

METHOD OF DETERMINING THE DEPTH OF OCCURRENCE OF A CHEMICALLY AGGRESSIVE BED

TECHNICAL FIELD

The present invention relates generally to well drilling techniques and more specifically, to methods of determining the depth of occurrence of chemically aggressive beds in the course of well drilling.

BACKGROUND ART

An exact determining of the depth of occurrence of chemically aggressive beds is necessitated by the fact that such beds as, say, saliferous ones prove to be unstable and tend to dissolve upon getting in contact with the drilling mud which results in a badly affected quality of the latter and in formation of cavities in the well being drilled, whereby some amount of the drilling mud is lost due to penetration into the cavities thus formed. All this imposes extra expenditures concerned with restoration of the drilling mud characteristics and replenishing the amount thereof.

One of the measures taken to eliminate such troubles resides in covering the aggressive beds with a casing string. If, however, the depth of occurrence and the zone of a bed are detected insufficiently accurately the casing string might be run down deeper than it is required or, conversely, it might prove shorter than necessary and thus fail to cover the whole bed.

Known in the art at the present time are some electrometric methods of detecting the depth of occurrence of the rock beds by measuring the potentials of intrinsic polarization of rock in the well with the use of an electrode sunk into the well through the cable. The electrode is then forced against the wall of the well and the electromotive force between the electrode sunk in the well and another electrode on the daylight surface is measured (cf. a text-book "Studies into sections of oil and gas wells by the intrinsic potential method" by B. Yu. Vendenshtain, issued 1966 by Nedra Publishers, Moscow/in Russian/). Said method involves much time to be spent for running the electrode down the well and hoisting it therefrom, as well as a great scope of jobs concerned with the determination of the depth of the bed occurrence.

Another method of detecting the depth of occurrence of a water-developing bed by transiently ceasing the mud injection into the well, followed by resuming the mud circulation, whereupon an amount of the drilling mud diluted with the bed fluid and returned from the well is registered and a change in the mud density as compared to the initial one is estimated. Besides, in the course of such a determination there is measured the period of time from the beginning of mud injection to the return of an amount of drilling mud diluted with the bed fluid (cf.n e.g., USSR Inventor's Certificate No. 484,301 cl. E 21 B, 47/04 published in the bulletin "Discoveries, inventions, industrial designs and trademarks" No. 34, 1975 /in Russian/).

Said method, however, is inapplicable for detecting the depth of occurrence of a chemically aggressive bed as such a bed does not change the density of the drilling mud upon getting in contact therewith.

DISCLOSURE OF THE INVENTION

It is an essential object of the present invention to provide a method of detecting the depth of occurrence of a chemically aggressive bed which, while being relatively simple, would be instrumental in accurately and quickly detecting the depth of occurrence and the interval of a chemically aggressive bed.

Said object is accomplished due to the fact that in a method of detecting the depth of occurrence of a chemically aggressive bed in the course of well drilling with the use of drilling mud wherein, according to the present invention there is measured preliminarily the value and direction of the oxidation-reduction (redox) potential of the drilling mud injected into the well, whereupon the walls of the well are stripped of the mud cake and a fresh amount of the drilling mud featuring its redox potential differing in the value and direction from that of the drilling mud located in the well, is injected into the latter until the drilling mud is completely expelled therefrom, after which the circulation of an additional amount of the drilling mud is stopped for a period of time within which relaxation of the ion-exchange processes between the chemically aggressive bed and the additional amount of the drilling mud occurs, whereupon said additional amount of the mud resumes circulation. While so doing one must register the time when the mud injection begins and when the additional amount of the drilling mud that has been in contact with the chemically aggressive bed, starts and stops returning to the surface, against the deviation of the value and direction of the mud redox potential, proceeding from which deviation the depth and interval of occurrence of the chemically aggressive bed are then estimated.

The proposed method is instrumental in attaining higher accuracy of detecting the depth of occurrence of a chemically aggressive bed due to an immediate contact of said bed with the drilling mud possessing a preliminarily known redox potential modifiable under the effect of ion-exchange processes proceeding between said aggressive bed and the drilling mud involved.

It is expedient that the value of the redox potential of an additional amount of the drilling mud be set within 1.6 to 1.8 V.

Such limits of the redox potential value have been found as a result of experimental studies and are characteristic of such redox potential values that do not lead to irreversible chemical reactions.

It has also been established experimentally that the period of relaxation of the ion-exchange processes running between the chemically aggressive bed and the additional amount of the drilling mud are expedient to fall within a period of from 1 to 300 s.

This means that within the above time interval there occur the ion-exchange processes resulting in an equilibrium state of the entire system. The relaxation time shorter than 1 s is inexpedient as said period of time is too short for the additional portion of the drilling mud to get in a physical contact with the chemically aggressive bed, that is, the mud has not time enough to penetrate into the crevices and pores of the bed due to a fairly high surface tension thereof.

On the other hand, the relaxation time in excess of 300 s might lead to some irreversible phenomena in the drilling mud due to a prolonged chemical attacking upon the drilling mud on the part of the bed which in turn might result in a complete degradation of the mud.

The proposed method enables one to detect the depth of occurrence and the interval of a chemically aggressive bed in a comparatively rapid and accurate way.

BRIEF DESCRIPTION OF THE DRAWINGS

In what follows the present invention will be exemplified in a detailed description of a specific illustrative embodiment thereof with reference to the accompanying drawing, wherein a diagrammatic representation of a drilling mud circulation pattern along the route "mud container—well being drilled—mud container" is shown.

BEST MODE FOR CARRYING OUT THE INVENTION

It is known commonly that termed as oxidation-reduction are such reactions that involve reciprocal oxidation or reduction of various substances. Taken as a measure of the intensity and rate of the redox processes proceeding in a heterophase polydisperse system, is a redox potential (i.e., oxidation-reduction potential) whose value depends upon the ratio of the oxidative and reductive forms of ions established in that system or introduced thereinto. A drilling mud is a complex polydisperse system incorporating a great many of chemical agents which interacts with one another, with the solid phase contained in the liquid, and with the liquid itself to give rise to some electrochemical reactions, the intensity and rate of said reactions being the function of a definite redox value characteristic of a given type (formulation) of the mud. Experimental findings that have been carried out with riverse types of drilling mud demonstrate that a most stable drilling mud features its redox potential to lie within 1.6 to 1.8 V. A deviation of the redox potential value by more than 0.2 to 0.5 V to either side might result in irreversible chemical reactions within the drilling mud itself which causes a degradation thereof. When a drilling mud is brought in contact with a chemically aggressive bed, such as halite (NaCl) this results that some redox reactions start occurring in the drilling mud which is in the state of equilibrium. Such reactions will call forth a change in the value of the mud redox potential. Thus, in order to prevent the mud from degradation and preclude the formation of bittern (i.e., an oversaturated salt solution), the drilling mud, before possible contact with a saliferous bed, has to be treated with some chemical agents, or within the zone of the negative electrode with a view to increasing the reducing properties thereof. The thus-prepared drilling mud featured by high reducing characteristics is injected into the well, whereupon its circulation is stopped. As a result, an ion-exchange sets out in the amount of the mud situated in the interval of the aggressive bed, whereby the reducing potential of the drilling mud is badly decreased. Upon resuming the mud circulation in the well and measuring the redox potential thereof after the return of the amount of the mud that has been in contact with the chemically aggressive bed, the value of the redox potential changes and remains constant within a lapse of time for the return of that amount of the mud, whereupon the value of the redox potential gets equal to that of the drilling mud being injected. Proceeding from a knowledge of the depth of the well and the rate of the mud injection thereinto one can find at a high degree of accuracy the depth of occurence and the interval of the bed under study.

Now reference is directed to a specific exemplary embodiment of the invention described hereinafter in detail.

To detect the depth and interval of occurrence of a chemically aggressive bed one must precedingly measure the redox potential of the drilling mud situated in a well 1, using a measuring transmitter 2 provided with an indicator 3. Then the walls of the well 1 are stripped of the mud cake so as to improve and intensify ion-exchange processes therewith.

Next an additional portion of the drilling mud is injected into the well 1 which has been prepared in a container 4 beforehand and features the properties that depend upon the readings taken by the measuring transmitter 2 and characterizing the value and direction of the oxidation-reduction reactions proceeding under the effect of chemical attacking of the bed AB. If the chemical attacking exerted by the bed increases the oxidation potential an additional portion of the drilling mud prepared in the container 4 features the redox potential value exceeding that indicated by the measuring transmitter 2 and directed towards reduction. This is necessitated to compensate for chemical attacking, since if the additional portion of the mud should have its redox potential equal by the value and direction to that of the mud situated in the well the chemical aggression of the bed would cause irreversible changes in the mud, i.e., the mud would be irreversibly deteriorated and should therefore be renewed completely.

The maximum values of the redox potentials which do not lead to irreversible effects in the drilling mud are within 1.6 to 1.8 V. If the absolute value of the redox potential is below 1.6 V, viz., with a further growth of reducing reactions the mud coagulates, whereas the redox potential value higher than 1.8 V will result in a growth of oxidation reactions, and the mud degrades.

Similarly, if the chemical aggression of the bed leads to an increase in the reducing potential an additional portion of the mud prepared in the container 4 features higher oxidative characteristics.

An additional portion of the drilling mud is prepared in the container 4 either with the use of some chemical agents fed from a bin 5 or by processing the mud in an electrolytic cell. The value of the redox potential of the drilling mud in the container 4 is monitored by a transmitter 6 provided with an indicator 7.

The additional portion of the drilling mud prepared in the container 4 is injected into the well 1 with the aid of a pump 8 until the mud situated in the well is completely expelled which can also be judged by a change in the redox potential. Then the mud circulation is suspended so as to let the additional portion of the mud get in contact with the chemically aggressive bed. As a result, some electrochemical reactions start proceeding in the amount of the additional drilling mud in contact with the bed AB, said reactions leading to a change in the redox potential of the mud.

As it has been stated hereinbefore the time of suspending the mud circulation is selected to be within 1 to 300 s depending upon the conditions of the surrounding medium (temperature and pressure). Then the circulation of the additional portion of the drilling mud resumes, the time of resuming being registered concurrently with measuring the redox potential by the transmitter 2. Thus, the transmitter 2 will indicate a sharp change in the redox potential of the mud at the moment when the additional portion of the drilling mud that has been in contact with the chemically aggressive bed AB starts returning from the well 1. In this case one must take notice of the time when the amount of the additional mud portion that has been in contact with the bed AB, starts flowing out of the well.

Similarly, the time when the amount of the additional mud portion that has been in contact with the bed AB stops flowing out of the well is noted by a change in the redox potential as measured by the transmitter 2.

Further on the depth of occurrence of the top and bottom of the chemically aggressive bed is estimated proceeding from the known formulas:

$$H_1 = \frac{Q - \Delta Q_1}{F} \cdot t_1,\ H_2 = \frac{Q - \Delta Q_2}{F} \cdot t_2$$

where $H_1$—the depth of occurrence of the bed of a chemically aggressive bed, m;

Q—pump displacement, $m^3/h$;

$t_1$—time interval between the starting of the mud circulation till the beginning of the return of the additional portion of the drilling mud, s;

$t_2$—time interval between the starting of the mud circulation till the terminating of the egress of the additional portion of the drilling mud, s;

$\Delta Q_1$—difference between the flow-rate of the drilling mud at the well inlet and outlet till the time interval $t_1$;

$H_2$—the depth of occurrence of the bottom of the chemically aggressive bed, m;

$\Delta Q_2$—difference between the flow-rates of the drilling mud at the well inlet and outlet till the time interval $t_2$, $m^3/h$;

F—the area of the well annular space, $m^2$.

Hence the difference between the values of $H_1$ and $H_2$ will be the interval of occurrence of the chemically aggressive bed.

Practical implementation of the proposed method will be instrumental in cutting down the time spent for detecting the location of a chemically aggressive bed, reducing expenditures and labour consumption, and ruling out any possibility of emergency situation.

INDUSTRIAL APPLICABILITY

The method of determining the depth of occurrence of a chemically aggressive bed can find most utility when applied in oil-and-gas production industry for drilling exploratory wells in geological prospecting works.

What is claimed is:

1. A method of determining the depth of occurrence of a chemically aggressive bed in the course of drilling a well with the use of a drilling mud, CHARACTERIZED in that the value and direction of the redox potential (the oxidation-reduction potential) of the drilling mud situated in the well are measured beforehand, whereupon the walls of the well are stripped of the mud cake, and an additional portion of the drilling mud featuring its redox potential differing as to the value and direction, from the redox potential of the drilling mud situated in the well is injected into the well until the mud is completely expelled therefrom, after which the circulation of the additional portion of the drilling mud is suspended for a period of time, wherein relaxation of the ion-exchange processes between the chemically aggressive bed and the additional portion of the drilling bed occurs, whereupon the additional portion of the mud resumes circulation, while the time interval between the resuming of the mud circulation till the beginning and end of returning the amount of the additional mud portion that has been in contact with the chemically aggressive bed, is registered against the deviation of the value and direction of the redox potential of the drilling mud, whereupon proceeding from said deviation the depth and interval of occurrence of the chemically aggressive bed is estimated.

2. A method as claimed in claim 1, CHARACTERIZED in that the redox potential value of the additional portion of the drilling mud is selected to be within 1.6 to 1.8 V.

3. A method as claimed in claim 1, CHARACTERIZED in that the relaxation period of the ion-exchange processes proceeding between the chemically aggressive bed and the additional portion of the drilling mud is limited to be within 1 to 300 s.

* * * * *